US008714734B2

(12) United States Patent
Sugitani

(10) Patent No.: US 8,714,734 B2
(45) Date of Patent: May 6, 2014

(54) INKJET PRINTER

(75) Inventor: Hiroshi Sugitani, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 163 days.

(21) Appl. No.: 13/360,036

(22) Filed: Jan. 27, 2012

(65) Prior Publication Data

US 2012/0218360 A1 Aug. 30, 2012

(30) Foreign Application Priority Data

Feb. 28, 2011 (JP) ..... 2011-041645

(51) Int. Cl.
*B41J 2/01* (2006.01)

(52) U.S. Cl.
USPC ..... 347/104; 347/101

(58) Field of Classification Search
USPC ..... 347/101, 104
See application file for complete search history.

(56) References Cited

U.S. PATENT DOCUMENTS 6,106,114 A * 8/2000 Sugiyama ..... 347/104
2006/0098070 A1 * 5/2006 Kumagai ..... 347/101

FOREIGN PATENT DOCUMENTS

JP 2006-137027 6/2006

* cited by examiner

*Primary Examiner* — Manish S Shah
*Assistant Examiner* — Yaovi Ameh
(74) *Attorney, Agent, or Firm* — Hamre, Schumann, Mueller & Larson, P.C.

(57) ABSTRACT

An inkjet printer includes: a transfer path configured to transfer a recording medium therein: an inkjet head disposed with a gap from the transfer path, and configured to discharge ink toward the recording medium being transferred in the transfer path; a gap adjuster configured to adjust the gap; a guide disposed upstream of the inkjet head in a transfer direction of the recording medium, and configured to prevent the recording medium from being uplifted from the transfer path; and a guide mover configured to move the guide toward the inkjet head in the transfer direction in response to an increase in the gap by the gap adjuster.

6 Claims, 5 Drawing Sheets

INKJET PRINTER

CROSS REFERENCE TO RELATED APPLICATION

This application is based upon and claims the benefit of priority from the prior Japanese Patent Application No. 2011-041645, filed on Feb. 28, 2011, the entire contents of which are incorporated herein by reference.

BACKGROUND OF THE INVENTION

1. Field of the Invention

The present invention relates to an inkjet printer, and particularly to an inkjet printer in which a gap between a transfer path and an inkjet head is variable.

2. Description of the Related Art

Inkjet printing on recording media such as paper sheets is achieved by discharging various color inks to recording media from the respective inkjet heads which are sequentially disposed along the transfer path of recording media.

For recording media transferred along the transfer path, it is important that their front end portions in the transfer direction should be prevented from being uplifted and coming into contact with the inkjet heads. As a countermeasure against this, Japanese Unexamined Patent Application Publication No. 2006-137027 has proposed a technique in which: multiple guide rollers are disposed in the widthwise direction of recording media in coordination with the disposition configuration of the inkjet heads, and are configured to press the recording media against the transfer path so that the recording media can pass under the undersurfaces, namely, the discharging surfaces of the respective inkjet heads.

SUMMARY OF THE INVENTION

On the other hand, deformation of a thick recording medium has a larger stiffness than that of a thin recording medium, and an end of the thick recording medium is easily curved to a large extent. For this reason, the end portion of the thick recording medium cannot be sufficiently pressed against the transfer path even though the guide rollers are disposed as shown in Japanese Unexamined Patent Application Publication No. 2006-137027. Hence there is a problem that the front end portions of the recording media in the course of transfer are likely to come into contact with the inkjet heads.

An object of the present invention is to provide an inkjet printer capable of sufficiently preventing front end portions of recording media in the course of transfer from coming into contact with the discharging surfaces of the respective inkjet heads even if the recording media are thick.

An aspect of the present invention is an inkjet printer comprising: a transfer path configured to transfer a recording medium therein: an inkjet head disposed with a gap from the transfer path, and configured to discharge ink toward the recording medium being transferred in the transfer path; a gap adjuster configured to adjust the gap; a guide disposed upstream of the inkjet head in a transfer direction of the recording medium, and configured to prevent the recording medium from being uplifted from the transfer path; and a guide mover configured to move the guide toward the inkjet head in the transfer direction in response to an increase in the gap by the gap adjuster.

Even if the recording medium is thick and its end portion is easily deformed, the foregoing aspect makes it possible to sufficiently prevent the front end portion of the recording medium in the course of transfer from coming into contact with the discharging surface of the inkjet head, because in response to an increase in the gap between the transfer path and the inkjet head, the guide disposed upstream of the inkjet head in the transfer direction moves toward the inkjet head in the transfer direction.

The guide may include a guide roller, and the guide mover may have a biasing unit configured to press the guide roller against the transfer path in a direction tilted downstream in the transfer direction.

The foregoing configuration makes it possible to simplify the constitution of the guide mover because: the guide roller is included as the guide; and the guide mover presses the guide roller against the transfer path in the direction tilted downstream in the transfer direction by use of the biasing unit.

A movement range of the guide roller toward the inkjet head in response to an increase in the gap may be a range up to a position immediately before a flight zone in which ink is flown from the inkjet head.

The foregoing configuration makes it possible to avoid the adhesion of the ink flown from the inkjet head to the guide roller even though the guide roller approaches the inkjet head, and to transfer the recording medium while preventing the front end portion of the recording medium from being uplifted until the front end portion reaches the position closest to the inkjet head, because the range in which the guide roller moves toward the inkjet head is the range up to the position falling short of the flight zone in which ink is flown from the inkjet head.

The inkjet printer may further comprise: a second guide disposed downstream of the inkjet head in the transfer direction of the recording medium, and configured to prevent the recording medium from being uplifted from the transfer path; and a second guide mover configured to move the second guide toward the inkjet head in a direction opposite to the transfer direction in response to an increase in the gap by the gap adjuster.

The foregoing configuration makes it possible to more securely prevent the front end portion of the recording medium in the transfer direction from coming into contact with the discharging surface of the inkjet head even if the recording medium is thick, because in response to an increase in the gap between the transfer path and the inkjet head, the second guide disposed downstream of the inkjet head in the transfer direction moves toward the inkjet head in the direction opposite to the transfer direction.

The second guide may include a second guide roller, the second guide mover may have a second biasing unit configured to press the second guide roller against the transfer path in a direction tilted upstream in the transfer direction.

The foregoing configuration makes it possible to simplify the constitution of the second guide mover, because the second guide roller is included as the second guide; and the second guide mover presses the second guide roller against the transfer path in the direction tilted upstream in the transfer direction by use of the second biasing unit.

BRIEF DESCRIPTION OF THE DRAWINGS

FIG. 2A is the view when a gap between a transfer path and inkjet heads is decreased, and FIG. 2B is the view when the gap is increased.

FIG. 4A is a schematic side view showing a state in which the gap is minimized. FIG. 4B is a schematic side view showing a state in which the gap is maximized. FIG. 4C is a partially-magnified cross-sectional view of the state shown in FIG. 4B.

FIG. 5A is the view when the gap is decreased, and FIG. 5B is the view when the gap is increased.

FIG. 6A is the view when the gap is decreased, and FIG. 6B is the view when the gap is increased.

DETAILED DESCRIPTION OF THE EMBODIMENTS

Figure 1:
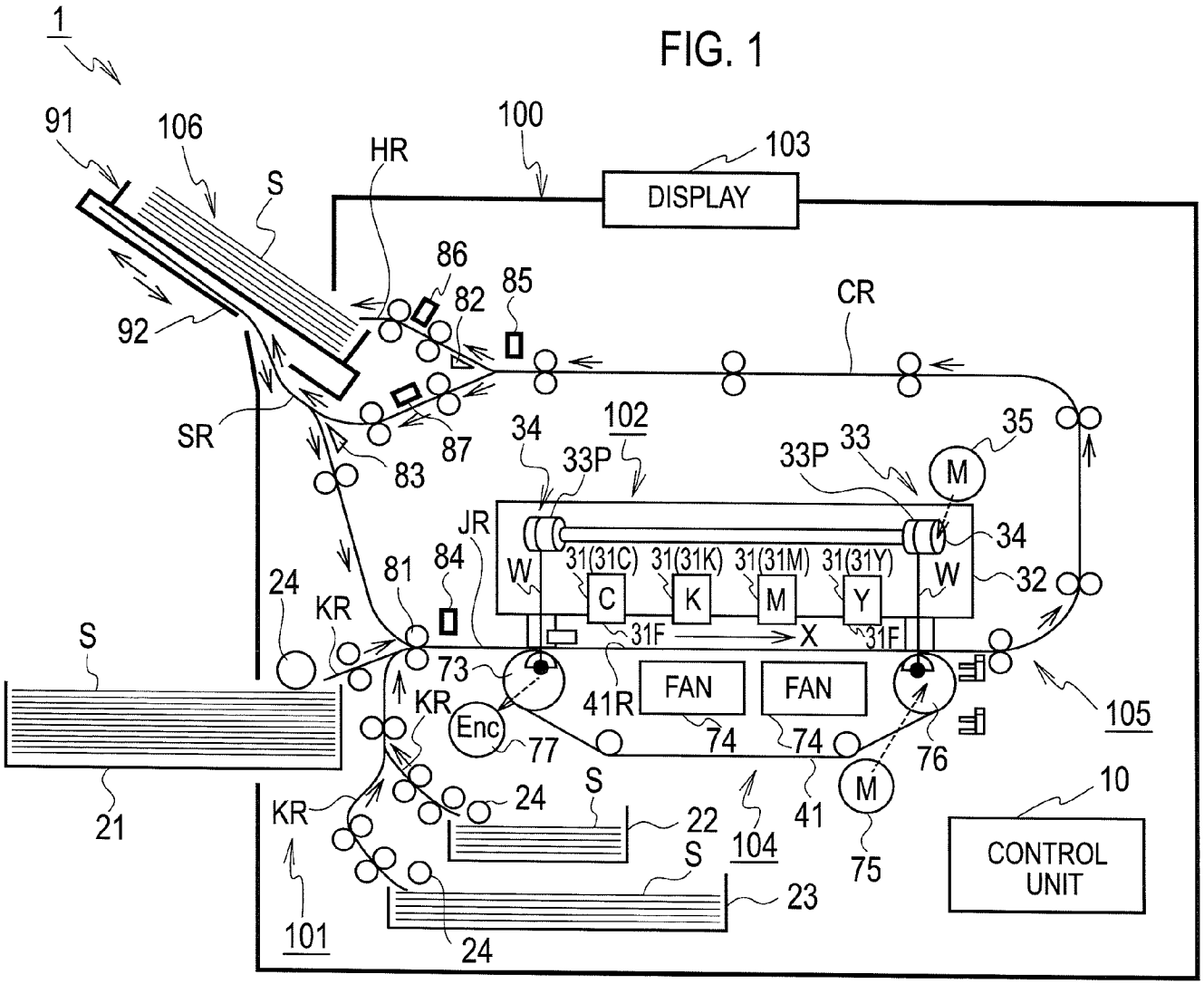
FIG. 1 is an explanatory view showing a schematic configuration of a line inkjet printer of a first embodiment of the present invention.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

First Embodiment

First of all, descriptions will be provided for a first embodiment. The following descriptions will be provided by taking an example in which: a recording sheet is used as a recording medium; an ordinary sheet is mainly used as a thin recording medium; and an envelope is mainly used as a thick recording medium.

FIG. 1 is an explanatory view showing a schematic configuration of a line inkjet printer 1 of the first embodiment of the present invention. As shown in FIG. 1, the line inkjet printer 1 (hereinafter simply referred to as an "inkjet printer 1") of the embodiment includes a control unit 10, a feeder 101, a print unit 102, a display 103, a belt platen mechanism 104, a recording sheet circulating transfer path 105 and a sheet discharge unit 106 inside or outside a housing 100.

Feeder

The feeder 101 includes: a side paper feed tray 21 disposed at a side of the housing 100, and multiple paper feed trays 22, 23 disposed in the lower left portion of the inside of the housing 100. The side paper feed tray 21 is designed in a way that makes recording sheets S (for example, envelopes) with an appropriate size capable of being stacked thereon while detecting the size of each recording sheet S. On the other hand, each of the multiple paper feed trays 22, 23 is designed in a way that makes thin recording sheets S (for example, ordinary sheets) with a specific size such as an A4 size or an A3 size capable of being stacked thereon.

From a pile of unprinted recording sheets S stacked on each of the side paper feed tray 21 and the multiple paper feed trays 22, 23, the topmost recording sheet S is fed by a corresponding one of paper feed rollers 24 on a one-by-one basis. Thereafter, the fed recording sheet S is transferred along a corresponding one of paper feed transfer paths KR by a corresponding one of driving mechanisms each including rollers, and a front portion of the fed recording sheet S is guided to paired resist rollers 81 provided in the recording sheet circulating transfer path 105. The paired resist rollers 81 synchronize the front position of the fed recording sheet S for alignment.

Print Unit

The print unit 102 is placed downstream of the feeder 101 and upstream of the recording sheet circulating transfer path 105, and is situated in the almost central portion of the inside of the housing 100. The print unit 102 is fixed to the housing 100.

In this print unit 102, multiple line inkjet heads 31 (hereinafter simply referred to as "heads 31") are disposed corresponding to multiple color inks in an order of cyan (C), black (K), magenta (M) and yellow (Y) from the upstream side to the downstream side. To put it specifically, from the upstream side to the downstream side, a head 31C for cyan, a head 31K for black, a head 31M for magenta and a head 31Y for yellow are disposed in this order.

The heads 31 for the respective colors are attached to a head holder 32, and are disposed in the belt platen mechanism 104 at equal intervals in a transfer direction X of the recording sheets S. A discharging surface 31F is formed in the lower portion of each head 31. Each color ink is designed to be discharged from the corresponding discharging surface.

It should be noted that although this embodiment is described by taking the example in which the four heads 31 are installed corresponding to the respective four color (C, K, M and Y) inks, the installation of at least one head 31 suffices because, for example, the head 31 for black can satisfy all the needs when characters alone are printed.

The head holder 32 is provided with a head gap adjusting unit 33 configured to suspend and support the belt platen mechanism 104 in a way that makes the belt platen mechanism 104 capable of ascending and descending. The head gap adjusting unit 33 includes: head gap adjusting mechanisms 34 having pulleys 33P and wires W, respectively; and a motor 35. The belt platen mechanism 104 suspended and supported by the head holder 32 by being connected to the wires W is designed to ascend and descend by winding and unwinding the wires W in conjunction with revolving of the pulleys 33P by the motor 35. As a result, the belt platen mechanism 104 is separated from the housing 100 in the mechanical terms.

As part of the print unit 102, the head gap adjusting unit 33 is connected to the control unit 10, and is driven under the control of the control unit 10. The belt platen mechanism 104 is caused to ascend or descend by the head gap adjusting unit 33 when, for example, the print mode is changed depending on which type the recording sheet S is of. One example of the change in the print mode is selection of a print mode for printing on an envelope whose sheet thickness is larger than that of an ordinary sheet. For this print mode change, the control unit 10 causes the belt platen mechanism 104 to descend, and a gap G (head gap), which is a distance between the heads 31 and a belt transfer path 41R (hereinafter simply referred to as a "transfer path 41R") formed by a transfer belt 41 (later described) of the belt platen mechanism 104, is made wider than usual.

Guide Rollers and Their Movement Mechanism

Figure 2A:
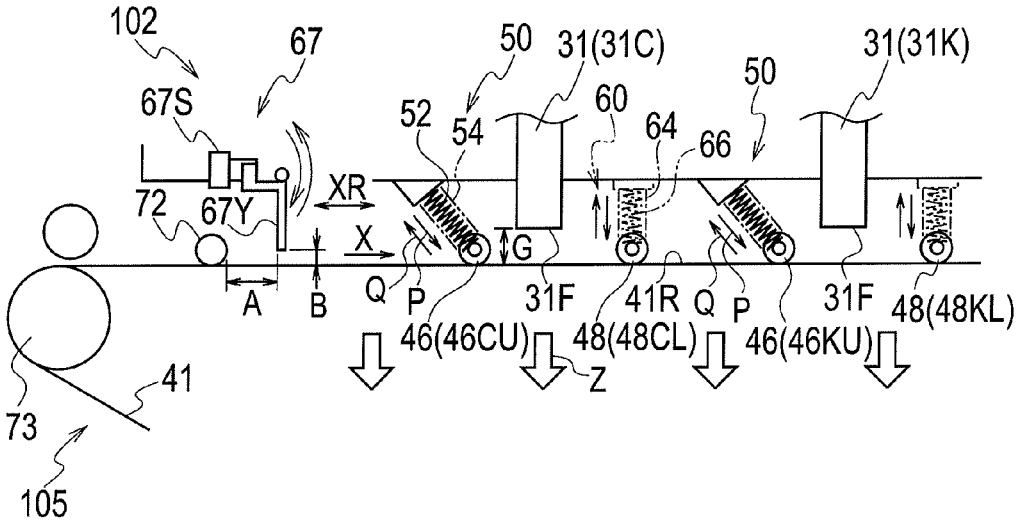
FIGS. 2A and 2B are partial side magnified views of the inkjet printer of the first embodiment of the present invention.
Figure 2B:
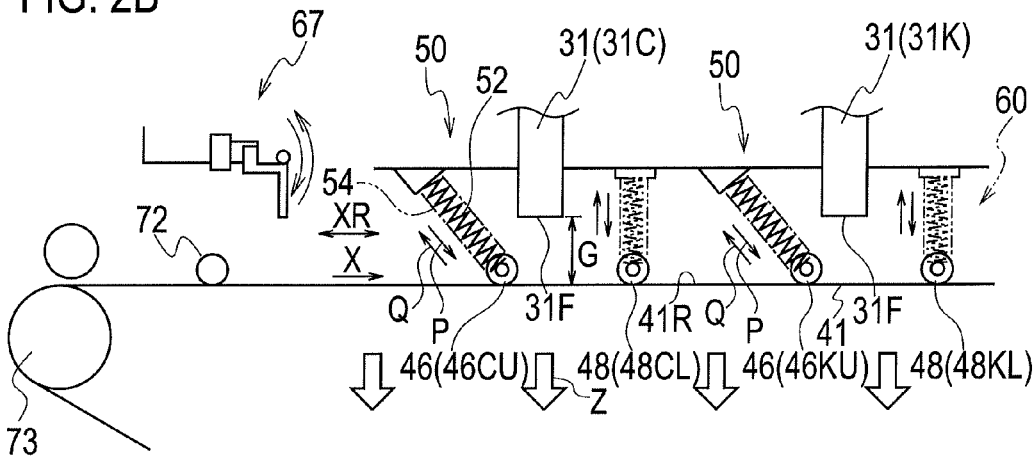

FIG. 2A is a partial side magnified view of the inkjet printer 1 when the gap G is decreased. FIG. 2B is a partial side magnified view of the inkjet printer 1 when the gap G is increased.

The print unit 102 includes: first guide rollers 46 disposed upstream of the respective heads 31 in the transfer direction (disposed in the sides of the respective heads 31 in a direction opposite to the transfer direction X); and second guide rollers 48 disposed downstream of the respective heads 31 (disposed in the sides of the respective heads in the transfer direction X). In this embodiment, the first guide rollers 46 are equivalent to the second guide roller 48, and vice versa.

To put it concretely, as shown in FIGS. 2A and 2B, a first guide roller 46CU is disposed upstream of the head 31C in the transfer direction, and a second guide roller 48CL is disposed downstream of the head 31C in the transfer direction. Similarly, a first guide roller 46KU is disposed upstream of the head 31K in the transfer direction, and a second guide roller 48KL is disposed downstream of the head 31K in the transfer stream. Similarly, a first guide roller is disposed upstream of each of the heads 31M, 31Y in the transfer stream, and a second guide roller is disposed downstream of each of the heads 31M, 31Y in the transfer direction.

Because the first guide rollers and the second guide rollers all have the same constitution, the following descriptions will be provided without specifically discriminating these guide rollers.

Figure 3:
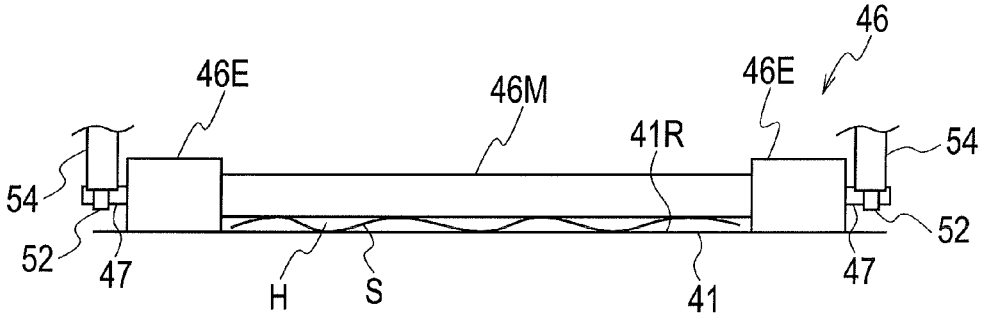
FIG. 3 is an explanatory view of a guide roller of the first embodiment of the present invention viewed from a downstream side in a transfer direction.

FIG. 3 is an explanatory view of the guide rollers 46 viewed from a downstream side in a transfer direction. In each first guide roller 46, as shown in FIG. 3, the diameter of the two end portions 46E is larger than that of the middle portion 46M. A space H is formed between the middle portion 46M and the transfer path 41R when the two end portions 46E are in contact with the transfer belt 41. This constitution makes the first guide roller 46 receive a rotary force from the transfer belt 41 via the two end portion 46E of the first guide roller 46, and the first guide roller 46 accordingly revolves in response to the rotation of the transfer belt 41. Even if the front end portion of the recording sheet S (the end portion of the recording sheet in the transfer direction) is deformed, the inkjet printer 1 guides the recording sheet S in the transfer direction while preventing the front end portion from being uplifted because the revolution of the first guide roller 46 guides the front end portion in a way that drags the front end portion into the space H. Furthermore, because the diameter of the middle portion 46M is smaller than that of the two end portions 46E, the printed surface of the recording sheet S is prevented from coming into contact with the first guide roller 46 and the second guide roller 48. In this respect, the deformation of the recording sheet S is mainly a curl or the like of a sheet end portion, but not deformation of the printed surface. Because the sheet end portion is not the printed surface, the printed surface will not become smeared even though the recording sheet S is guided downstream of the head 31 after printing in the way that makes the recording sheet S dragged by the middle portion 46M of the guide roller in this manner.

Figure 4A:
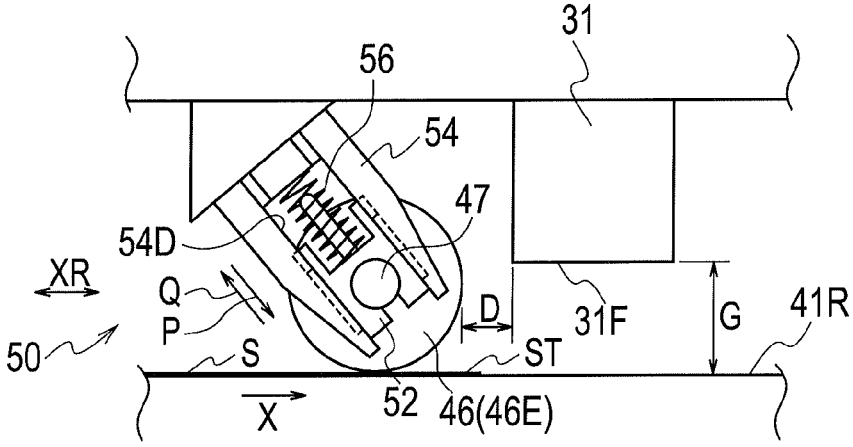
FIGS. 4A to 4C show the first embodiment of the present invention.
Figure 4B:
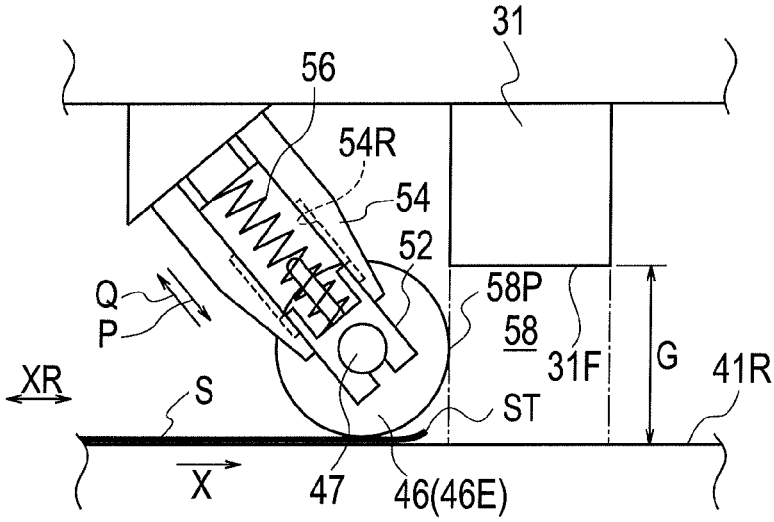
Figure 4C:
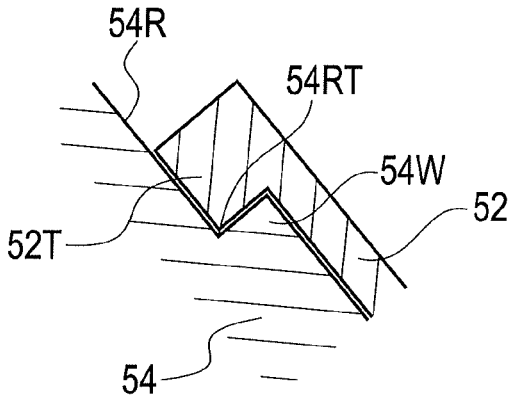

FIG. 4A is a schematic side view showing a state in which the gap G is minimized. FIG. 4B is a schematic side view showing a state in which the gap G is maximized. FIG. 4C is a partially-magnified cross-sectional view of the state shown in FIG. 4B.

As shown in FIGS. 2A and 2B as well as FIGS. 4A to 4C, the print unit 102 further includes guide roller holding/biasing units 50 configured to hold the corresponding first guide rollers 46, and concurrently configured to bias the corresponding first guide rollers 46 in a direction tilted downward in the transfer direction (hereinafter referred to as a "transfer downstream-side tilted direction P"), respectively.

Each first guide roller 46 includes held shafts 47 (see FIG. 3 as well) which are shaped like a short column and extend out from the respective two end portions 46E of the first guide roller 46 in the axial direction. Each guide roller holding/biasing unit 50 includes: guide roller holders 52 configured to rotationally hold the held shafts 47; slide holders 54 provided to the head holder 32 integrally or separately, and configured to slidably hold the guide roller holders 52; and compression coil springs 56 configured to bias the guide roller holders 52 in the transfer downstream-side tilted direction P.

A housing recessed portion 54D configured to house the corresponding compression coil spring 56 is formed in each slide holder 54. The upper end portion of the compression coil spring 56 is held by the upper end portion of the housing recessed portion 54D, while the lower end portion of the compression coil spring 56 is in contact with the corresponding guide roller holder 52 and biases the guide roller 46. In addition, a slide path 54R configured to guide the guide roller holder 52 in the transfer downstream-side tilted direction P and in the opposite direction Q is formed in the slide holder 54. On the other hand, a slide protrusion 52T (see FIG. 4C) configured to reciprocate in the slide path 54R is formed in the guide roller holder 52.

In this respect, each first guide roller 46 is in contact with the transfer path surface of the transfer belt 41. As a result, when the gap G is changed, the guide roller holders 52 slide in the corresponding slide paths 54R, and the positions of the respective two end portions 46E of the first guide roller 46 in the vertical direction and in the transfer direction accordingly change.

Once each compression coil spring 56 is compressed as a result of the decrease in the gap G, the corresponding first guide roller 46 ascends along the corresponding slide path 54R, and becomes situated in a position upstream of and away from the corresponding head 31 in the transfer direction, as shown in FIG. 4A. Once the compression coil spring 56 expands as a result of the increase in the gap G, the first guide roller 46 descends along the slide path 54R, and becomes situated in a position closer to the head 31, as shown in FIG. 4B. In this embodiment, the moving range of each first guide roller 46 toward the corresponding head 31 in response to an increase in the gap G is a range up to a position 58P immediately before a flight zone 58 in which ink is flown from the head 31. The position of a lower end 54RT of the slide path 54R is set in order for this range to be realized. As shown in FIG. 4C, a wall 54W forming the lower end 54RT is designed to function as a stopper when the corresponding slide protrusion 52T comes into contact with the wall 54W.

The print unit 102 further includes second guide roller holding/biasing units 60 (see FIGS. 2A and 2B) configured to hold the second guide rollers 48 disposed downstream of the heads 31 in the transfer direction, and concurrently to bias the second guide rollers 48 downward (in a direction orthogonal to the transfer surface). For example, each second guide roller holding/biasing unit 60 has a structure in which: the second guide roller holding/biasing unit 60 includes second slide holders 64 each having a constitution similar to those of slide holders 54 with their slide paths being directed in the vertical direction (that is to say, in the direction orthogonal to the transfer surface), and second compression coil springs 66 held by the respective second slide holders 64; and guide roller holders configured to rotationally hold the corresponding second guide roller 48 are caused to reciprocate in the vertical direction by the biasing forces of the second compression coil springs 66, respectively. Otherwise, the second guide roller holding/biasing unit 60 may be provided to the belt platen mechanism 104 as in the case of a part configured to hold an SS roller 72 which will be described later. The second guide roller holding/biasing unit 60 may have a general roller holding structure.

With regard to this embodiment, the guide roller holding/biasing units 50 and the second guide roller holding/biasing units 60 are attached to the print unit 102. For this reason, the first guide rollers 46, the second guide rollers 48, the guide roller holding/biasing units 50 and the second guide holding/biasing units 60 are described while the print unit 102 is described, for the sake of explanatory convenience.

Deformation Detecting Sensor

In addition, the print unit 102 is provided with a deformation detecting sensor 67 between the first guide roller 46CU and the SS roller 72. The deformation detecting sensor 67 is configured to detect deformation of the front end portion ST of a recording sheet S when the gap G becomes equal to a smaller set value (for example, a value set for thin recording sheets whose front end portions ST are less likely to deform). To put it concretely, the deformation detecting sensor 67 includes: a swinging member 67Y pivotally supported in a way that makes the swinging member 67Y swingable around a shaft orthogonal to the transfer direction X, and looking like a crank when viewed from the side; and a swing detecting sensor 67S configured to detect the swing of the deformation detecting sensor 67.

As shown in FIG. 2A, the lower end of the swinging member 67Y is spaced out from the upper surface (transfer surface) of the transfer belt 41 by a predetermined distance B, and is spaced out from the SS roller 72 by a distance A in the transfer direction X. If the front end portion ST (see FIGS. 4A and 4B) of a deformed recording sheet S is uplifted and comes into contact with the swinging member 67Y after passing the SS roller 72, the swinging member 67Y is pushed and swung forward. This swing detaches the opposite end portion of the swinging member 67Y from the swing detecting sensor 67S. As a result, it is detected that the deformation of the recording sheet S exceeds an allowable value. Once this detection is made, a detection signal is transmitted to the control unit 10, and the control unit 10 stops the transfer. Incidentally, a structure in which this recording sheet S is discharged may be used instead of the structure in which the transfer is stopped.

Belt Platen Mechanism

The belt platen mechanism 104 is placed under the multiple heads 31 while opposed to the print unit 102.

In the belt platen mechanism 104, the endless transfer belt (belt platen) 41 in which multiple suction holes (not illustrated) are formed is laid between a driving pulley 76 rotationally driven by a motor 75 and a driven pulley 73 for the purpose of transferring an unprinted recording sheet S fed from the feeder 101 or a recording sheet S with its one side already printed, which is transferred by a circulation transfer path JR (later described), while placing the recording sheet S on the transfer belt 41. The transfer path 41R is formed by this transfer belt 41. Incidentally, the transfer path 41R constitutes part of the circulation transfer path JR (later described).

A speed at which the transfer belt 41 is moved by the motor 75, that is to say, a speed at which a recording sheet S is transferred by the transfer belt 41 can be detected by the control unit 10 on the basis of an output from an encoder 77. Suction fans 74 each configured to generate a negative pressure for drawing the recording sheet S onto the transfer belt 41 by air suction are provided between the driving pulley 76 and the driven pulley 73. Arrows Z in FIGS. 2A, 2B, 5A, 5B, 6A and 6B denote the direction in which air is sucked.

The transfer belt 41 has the multiple suction holes (not illustrated) which are disposed in the back side of the transfer belt 41 and communicate with the suction fans 74. A suction force generated by the suction fans 74 is supplied to the suction holes. Accordingly, a suction force, directed toward the transfer belt 41, attributable to a negative pressure which is generated by the suction holes closed by the recording sheet S reacts on the recording sheet S on the transfer belt 41.

In the belt platen mechanism 104, when a recording sheet S is placed on the belt-shaped transfer belt 41, the recording sheet S is transferred in the transfer direction X (vertical scanning direction) by the rotation of the transfer belt 41 while the recording sheet S is fixed to the top of the transfer belt 41 by drawing the recording sheet S by the air suction through the suction holes in the transfer belt 41. A full color image is printed on the recording sheet S in the course of transfer by the multiple heads 31 of the print unit 102 which are disposed above the passage path.

Furthermore, in the belt platen mechanism 104, the SS roller 72 in contact with the transfer path 41R is placed upstream of the first guide roller 46CU in the transfer direction. The SS roller 72 is a press roller configured to press the center portion of the recording sheet S being transferred on the transfer path 41R. To put it specifically, the SS roller 72 is a roller which is designed to press the center portion of the recording sheet S mainly with its central portion, and in which a groove with a smaller diameter is formed in its two end portions. The recording sheet S is sucked to the transfer belt 41 while the SS roller 72 leaves no interstice between the recording sheet S and the transfer belt 41.

Recording Sheet Circulating Transfer Path

The recording sheet circulating transfer path 105 includes the circulation transfer path JR configured to circulate a recording sheet S, which is fed from the feeder 101, via the print unit 102 for the purpose of subjecting the recording sheet S to single-sided printing or double-sided printing in the print unit 102. The paper feed transfer paths KR configured to transfer an unprinted recording sheet S fed from the side paper feed tray 21 and paper feed trays 22, 23, and a sheet discharge transfer path HR configured to transfer a printed recording sheet S to a paper receiving tray 91 are placed in the circulation transfer path JR in a way that makes the paper feed transfer paths KR and the sheet discharge transfer path HR branched from the circulation transfer path JR.

Moreover, the circulation transfer path JR is installed in the shape of a loop, including: a common transfer path CR configured to transfer a printed recording sheet S, whose one side (top) is printed by the print unit 102, in a direction for direct discharge; and a switchback transfer path SR configured to subject a recording sheet S, whose one side (top) is printed, to double-sided printing (top-side printing and back-side printing) by turning the recording sheet S back in the middle of the common transfer path CR with the transfer direction switched by first and second transfer path switching levers 82, 83 each using a solenoid valve and the like.

Thus, the circulation transfer path JR enables a recording sheet S, which is intended to be subjected to double-sided printing, to circulate via the print unit 102.

In this respect, the common transfer path CR in the circulation transfer path JR is curved in a way that makes the common transfer path CR pass under the print unit 102 and thereafter go around above the print unit 102 for the purpose of securing time needed to dry ink on the printed recording sheet S. The recording sheet S to be discharged is transferred in a way that makes the recording sheet S move toward the paper receiving tray 91 of the sheet discharge unit 106 via the common transfer path CR and the sheet discharge transfer path HR.

On the other hand, the switchback transfer path SR in the circulation transfer path JR is provided in a way that: the recording sheet S is moved toward the inside of a recording sheet guiding frame 92, which is formed at the back of the paper receiving tray 91 of the sheet discharge unit 106, with the transfer direction of the recording sheet S changed by switching the first transfer path switching lever 82 while the recording sheet S is en route to the sheet discharge unit 106 in the common transfer path CR; after reversing the front position of the recording sheet S inside the recording sheet guiding frame 92, the recording sheet S is again moved toward the paired resist rollers 81 with the transfer direction of the recording sheet S changed by switching the second transfer path switching lever 83; and the recording sheet S is thereafter sent to the print unit 102 and the belt platen mechanism 104.

In addition, first to fourth recording sheet detecting optical sensors 84 to 87 of a light reflection type (or of a transmission type) are installed in the recording sheet circulating transfer path 105. The first recording sheet detecting optical sensor 84 is placed downstream of the paired resist rollers 81 in the paper feed transfer path KR, and functions as a paper feed sensor configured to detect how each recording sheet S is fed. Furthermore, the first recording sheet detecting optical sensor 84 is formed from a line sensor whose dimension is not less than the largest width among the recording sheets S, which are fed from the feeder 101, in the main scanning direction. Accordingly, the first recording sheet detecting optical sensor 84 functions, too, as a recording sheet size sensor (contact image sensor: CIS) configured to detect the sizes of the respective recording sheets S, which are fed from the feeder 101, on the basis of the dimensions of the recording sheets S in the main scanning direction and a length of time that each recording sheet S takes to pass the sensor.

The second recording sheet detecting optical sensor 85 functions as a pre-transfer path switch sensor configured to detect how each recording sheet S is before reaching the sheet discharge transfer path HR or the switchback transfer path SR. The third recording sheet optical sensor 86 is placed along the sheet discharge transfer path HR, and functions as a sheet discharge sensor configured to detect how each recording sheet S moving to the paper receiving tray 91 is delivered. In addition, the fourth recording sheet detecting optical sensor 87 is placed between the first transfer path switching lever and the second transfer path switching lever 83, and functions as a circulating recording sheet detection sensor configured to detect whether a circulating recording sheet S is present or absent.

Sheet Discharge Unit

The sheet discharge unit 106 includes the paper receiving tray 91 which is set diagonally to the housing 100.

The paper receiving tray 91 has: a function of housing printed recording sheets S which are transferred by the common transfer path CR and the sheet discharge transfer path HR provided in the recording sheet circulating transfer path 105; and a function of reversing the front position of a recording sheet S, whose one side (top) is printed, in the recording sheet guiding frame 92 formed at the back of the paper receiving tray 91 by turning the recording sheet S back for the purpose of subjecting the recording sheet S to back-side printing.

Functions and Effects

Descriptions will be hereinbelow provided for the functions and effects of the embodiment. When recording sheets S whose front end portions ST are unlikely to deform while kept in storage are used, for example, when recording sheets S are thin sheets such as ordinary sheets, its selection is inputted through the display 103. As a result, an instruction from the control unit 10 is transmitted to the head gap adjusting unit 33, the pulleys 33P are caused to revolve by the motor 35, the wires W are wound by the respective pulleys 33P, and the belt platen mechanism 104 ascends. Subsequently, the revolution of the motor 35 is stopped once the gap G becomes equal to the predetermined set value (the gap value for thin recording sheets). Thereby, the ascent of the belt platen mechanism 104 is stopped (see FIGS. 2A and 2B). Incidentally, this set value is a value beforehand set up in the control unit 10.

During this ascent, the first guide rollers 46 ascend in conjunction with the ascent of the transfer belt 41. For this reason, the guide roller holders 52 ascend. As a result, the guide roller holders 52 are guided by the corresponding slide paths 54R, and thus move in the opposite direction Q to the transfer downstream-side tilted direction P. Concurrently, the compression coil springs 56 are compressed. Accordingly, the first guide rollers 46 move on the transfer path 41R in the direction (vertical scanning direction XR) opposite to the transfer direction X, and become situated in the positions upstream of and away from the respective heads 31 in the transfer direction.

While in this state, only recording sheets S, whose deformation is not detected by the deformation detecting sensor 67, pass the deformation detecting sensor 67, and reach the first guide rollers 46. Because the recording sheets S are thin, no large deformation (for example, a large curl) occurs in their front end portion ST. In addition, because the recording sheets S are thin, it is easy for the air suction by the suction fans 74 to sufficiently prevent the recording sheets S from being uplifted from the transfer belt 41. For these reasons, even though the first guide rollers 46 are upstream of and away from the respective heads 31 in the transfer direction by a distance D (see FIG. 4A) in this manner, it is possible to prevent the front end portions ST from coming into contact with the heads 31 after the recording sheets S pass the first guide rollers 46.

When recording sheets S whose front end portion ST are likely to deform while kept in storage are used, for example, when recording sheets S are thick sheets such as envelopes, its selection is inputted through the display 103. As a result, an instruction from the control unit 10 is transmitted to the head gap adjusting unit 33, the pulleys 33P are caused to revolve by the motor 35, the wires W are unwound by the respective pulleys 33, and the belt platen mechanism 104 descends. Subsequently, the revolution of the motor 35 is stopped once the gap G becomes equal to the predetermined set value (the gap value for thick recording sheets). Thereby, the descent of the belt platen mechanism 104 is stopped (see FIGS. 2B and 4B). Incidentally, this set value is a value beforehand set up in the control unit 10.

During this descent, the guide roller holders 52 descend due to the biasing forces of the compression coil springs 56 in conjunction with the descent of the transfer belt 41. As a result, the guide roller holders 52 are guided by the corresponding slide paths 54R, and move in the transfer downstream-side tilted direction P. Concurrently, the compression coil springs 56 expand. Accordingly, the first guide rollers 46 move on the transfer path 41R toward the heads 31 in the transfer direction X (vertical scanning direction XR), and become situated in the positions close to the heads 31, respectively. At this time, the slide protrusions 52T of the guide roller holders 52 come into contact with the lower ends 54RT of the slide paths 54R, and the movement of the first guide rollers 46 is thereby stopped.

While in this state, the first guide rollers 46 prevent the front end portions ST of the respective recording sheets S from being uplifted, until the front end portions ST are transferred closer to the heads 31. For this reason, even if thick recording sheets S are envelopes whose end portions are likely to be curled, their front end portions ST are prevented from coming into contact with the discharging surfaces 31F of the respective heads 31 and the like. Incidentally, the gap G and the stop positions of the respective first guide rollers 46 at this time are set up with consideration given to a curled shape and the like which are expected to occur in the front end portions ST.

It is desirable that as shown in FIG. 4B, the position which each first guide roller 46 reaches when approaching the corresponding head 31, and which is closest to the head 31, should be the position 58P falling short of the flight zone 58 in which ink is flown from the head 31. This makes it possible to avoid the adhesion of the ink flown from the head 31 to the first guide roller 46 even though the first guide roller 46 approaches the head 31, and concurrently to transfer each recording sheet S while preventing the front end portion ST from being uplifted until the front end portion ST reaches the position closest to the head 31.

As described above, in this embodiment, once the gap G is increased by causing the belt platen mechanism 104 to descend, each compression coil spring 56 expands in conjunction with this, and the corresponding first guide roller 46 moves in the transfer downstream-side tilted direction P. As a result, the first guide roller 46 approaches the corresponding head 31. On the other hand, once the gap G is decreased by causing the belt platen mechanism 104 to ascend, the first guide roller 46 moves upward in conjunction with this, and the compression coil spring 56 is compressed, as well as the first guide roller 46 moves in the opposite direction Q to the transfer downstream-side tilted direction P. As a result, the first guide roller 46 comes upstream of and away from the head 31 in the transfer direction.

In sum, each first guide roller 46 comes closer to or away from the corresponding head 31 in conjunction with the increase or decrease in the gap G. Even if recording sheets S are so thick that the front end portions ST of the respective recording sheets S are likely to deform, or even if recording sheets S is so thin that the front end portions ST of the respective recording sheets S are unlikely to deform, it is possible to easily prevent the front end portions ST in the course of transfer from coming into contact with the head 31.

In addition, the guide roller holding/biasing units 50 are provided as the mechanisms configured to cause the first guide rollers 46 to come closer or away. Each guide roller holding/biasing unit 50 includes the guide roller holder 52, the slide holder 54 and the compression coil spring 56. The guide roller holding/biasing unit 50 biases the corresponding first guide roller 46 in the transfer downstream-side tilted direction P. This makes it possible to simplify the constitution of the guide roller holding/biasing unit 50.

A configuration in which each first guide roller 46 is put close to the corresponding head 31 in the initial state irrespective of whether the gap G is large or small would make the vicinity of the head crowded with members, and accordingly would complicate the apparatus configuration around the head. Furthermore, this configuration would make it likely that maintenance service for keeping the discharging capability of the head 31 could not be provided sufficiently, because the first guide roller 46 would be situated so close to the head 31 in the transfer direction, and the gap G would be so small, that the first guide roller 46 would hinder the maintenance service person from providing the maintenance service. For these reasons, the configuration of the embodiment in which the first guide roller 46 is put away from the head 31 when the gap G is decreased makes it possible to obtain an effect of removing the obstacle to the maintenance service.

Figure 5A:
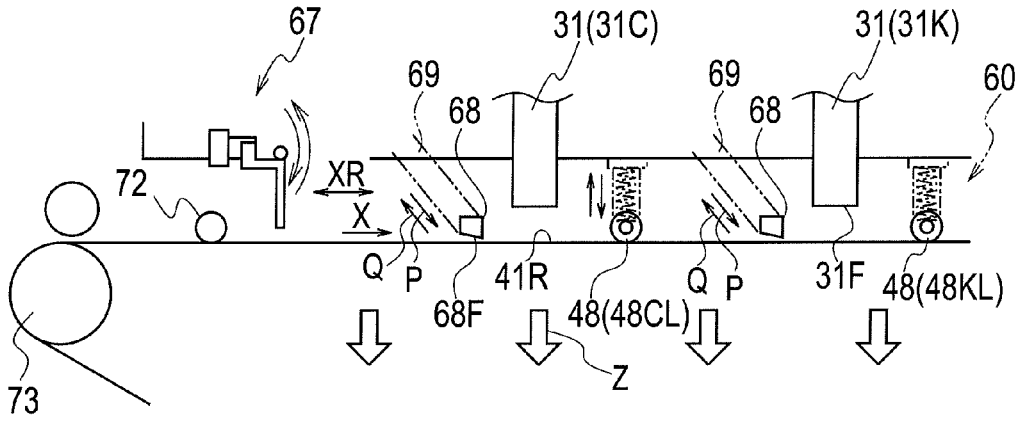
FIGS. 5A and 5B are partial side magnified views of the inkjet printer according to a modified example of the first embodiment of the present invention.
Figure 5B:
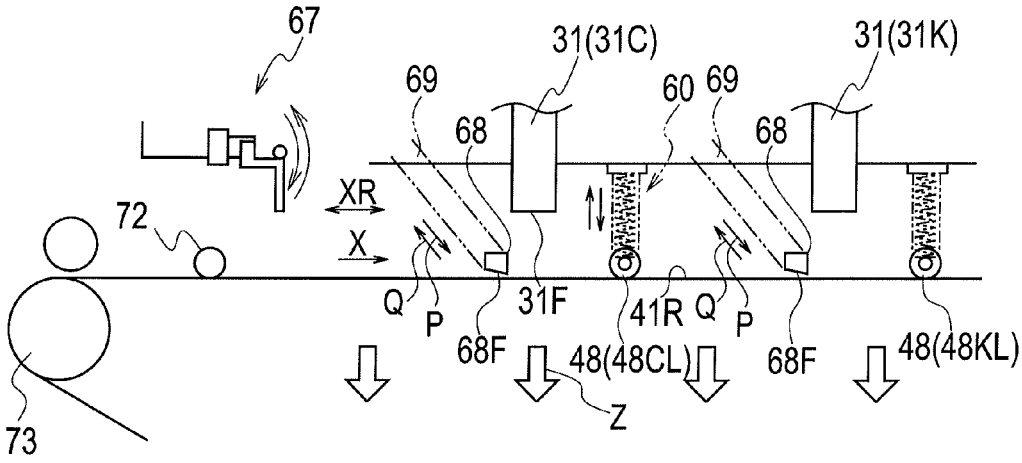

Although the foregoing descriptions have been provided for the embodiment by taking the case where the first guide rollers 46 prevent the front end portions ST of the respective recording sheets S from being uplifted, the preventive instruments are not limited to the guide rollers. Instead, other guides may be used as long as they are capable of preventing this uplift. For example, a configuration may be used in which: as shown in 5A and 5B, guides 68 are attached to the head holder 32 in a way that makes the guides 68 capable of reciprocating in the transfer downstream-side tilted direction P and in the opposite direction Q; as shown in FIG. 5B, in response to an increase in the gap G, the guides 68 move (descend) in the transfer downstream-side tilted direction P; and as shown in FIG. 5A, in response to a decrease of the gap G, the guides 68 move (ascend) in the opposite direction Q to the transfer downstream-side tilted direction P.

In this case, for example, the head holder 32 is provided with movement mechanisms configured to move the respective guides 68, and the setting of the positions of the guides 68 is controlled by the control unit 10 in accordance with the gap G to be set up. Each guide 68 is, for example, a long member whose undersurface has an inclined surface 68F which becomes gradually inclined downward in the transfer direction X (toward the downstream of the transfer). A plane, a curved convex surface or the like may be used instead of the inclined surface 68F.

As each movement mechanism, for example, a guide holder 69 configured to hold the two end portions of the corresponding guide 68 and being capable of reciprocating in the transfer downstream-side tilted direction P and in the opposite direction Q is provided to the head holder 32, and the movement of the guide holder 69 is controlled by the control unit 10.

Although the foregoing descriptions have been provided for the embodiment by taking the configuration in which the head gap adjusting unit 33 configured to suspend and support the belt platen mechanism 104 in a way that makes the belt platen mechanism 104 capable of ascending and descending is provided as part of the print unit 102, the gap G may be changed by use of a different mechanism.

Second Embodiment

Figure 6A:
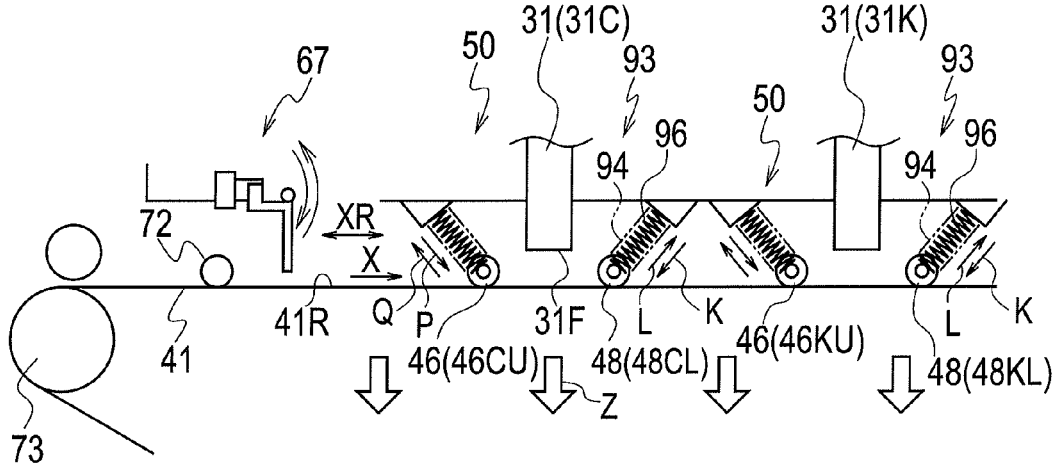
FIGS. 6A and 6B are partial side magnified views of the inkjet printer of a second embodiment of the present invention.
Figure 6B:
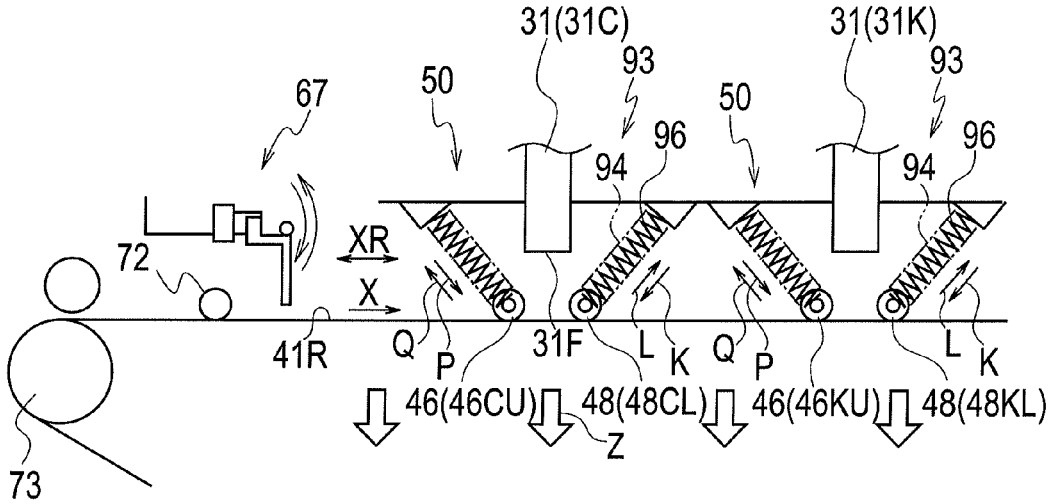

Next, descriptions will be provided for a second embodiment. FIG. 6A is a partial side magnified view of an inkjet printer of the embodiment when a gap G is decreased, and FIG. 6B is a partial side magnified view of the inkjet printer of the embodiment when the gap G is increased. The line inkjet printer of the embodiment is different from the inkjet printer 1 of the first embodiment in terms of second guide roller holding/biasing units 93.

Each second guide roller holding/biasing unit 93 includes a second slide holder 94 which has a constitution similar to that of the slide holder 54, and in which a slide path is formed in a direction tilted downward in a direction opposite to the transfer direction (hereinafter referred to as a "transfer upstream-side tilted direction K"). Each second guide roller holding/biasing unit 93 further includes: a guide roller holder having the same constitution as does the guide roller holder 52 described with regard to the first embodiment; and a second compression coil spring 96 held by the second slide holder 94. This configuration causes the guide roller holder to be biased by the second compression coil spring 96, and accordingly enables the guide roller holder to reciprocate in the transfer upstream-side tilted direction K and in an opposite direction L to the transfer upstream-side tilted direction K.

Like the first embodiment, this embodiment increases the gap G to a predetermined set value by causing the belt platen mechanism 104 to descend, when thick sheets such as envelopes are used as recording sheets S. During this descent, the guide roller holder configured to hold the guide roller 48 is caused to descend by a biasing force of the second compressing coil spring 96 in conjunction with the descent of the transfer belt 41. As a result, as shown in FIG. 6B, the guide roller 48 moves in the transfer upstream-side tilted direction K, moves on the transfer path 41R toward the corresponding head 31 in a direction (the vertical scanning direction XR) opposite to the transfer direction X, and approaches the head 31. While in this state, the second guide roller 48 further prevents the front end portions ST of the respective recording sheets S, which pass under the head 31, from being uplifted in addition to the effects described with respect to the first embodiment. Accordingly, it is possible to more securely prevent the recording sheets S from coming into contact with the discharging surface 31F of the head 31.

Like the first embodiment, this embodiment decreases the gap G to a predetermined set value by causing the belt platen mechanism 104 to ascend, when thin sheets such as ordinary sheets are used as recording sheets S. During this ascent, the guide roller holder ascends in conjunction with the ascent of the transfer belt 41. As a result, as shown in FIG. 6A, the second guide roller 48 moves in the opposite direction L to the transfer upstream-side tilted direction K, moves on the transfer path 41R in the transfer direction X, and comes away from the head 31.

An inkjet printer according to the embodiments of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a transfer path configured to transfer a recording medium therein;

an inkjet head disposed with a gap from the transfer path, and configured to discharge ink toward the recording medium being transferred in the transfer path;

a gap adjuster configured to adjust the gap;

a first guide disposed upstream of the inkjet head in a transfer direction of the recording medium, and configured to prevent the recording medium from being uplifted from the transfer path; and a first guide mover configured to move the first guide toward the inkjet head in the transfer direction in response to an increase in the gap by the gap adjuster.

2. The inkjet printer according to claim 1, wherein the first guide includes a first guide roller, and the first guide mover has a biasing unit configured to press the first guide roller toward the transfer path in a direction tilted downstream in the transfer direction.

3. The inkjet printer according to claim 2, wherein a movement range of the first guide roller toward the inkjet head in a response to an increase in the gap is a range up to a position immediately before a flight zone in which ink is flown from the inkjet head.

4. The inkjet printer according to claim 1, wherein the first guide mover is configured to move the first guide in the transfer direction in response to the increase in the gap by the gap adjuster so that the recording medium is guided by the first guide at a position closer to the inkjet head when the gap becomes larger.

5. An inkjet printer comprising:

a transfer path configured to transfer a recording medium therein;

an inkjet head disposed with a gap from the transfer path, and configured to discharge ink toward the recording medium being transferred in the transfer path;

a gap adjuster configured to adjust the gap;

a first guide disposed upstream of the inkjet head in a transfer direction of the recording medium, and configured to prevent the recording medium from being uplifted from the transfer path;

a first guide mover configured to move the first guide toward the inkjet head in a transfer direction in response to an increase in the gap by the gap adjuster;

a second guide disposed downstream of the inkjet head in the transfer direction of the recording medium, and configured to prevent the recording medium from being uplifted from the transfer path; and a second guide mover configured to move the second guide toward the inkjet head in a direction opposite to the transfer direction in response to an increase in the gap by the gap adjuster.

6. The inkjet printer according to claim 5, wherein the second guide includes a second guide roller, and the second guide mover has a second biasing unit configured to press the second guide roller toward the transfer path in a direction tilted upstream in the transfer direction.

* * * * *